US005902980A

United States Patent [19]

Reincke et al.

[11] Patent Number: 5,902,980

[45] Date of Patent: May 11, 1999

[54] INSULATING COMPONENT FOR HIGH-VOLTAGE EQUIPMENT

[75] Inventors: Frank Reincke; Norbert Trapp, both of Berlin, Germany

[73] Assignee: Siemens Aktiengesellschaft, München, Germany

[21] Appl. No.: 08/973,738

[22] PCT Filed: May 15, 1996

[86] PCT No.: PCT/DE96/00911

§ 371 Date: Feb. 17, 1998

§ 102(e) Date: Feb. 17, 1998

[87] PCT Pub. No.: WO96/37902

PCT Pub. Date: Nov. 28, 1996

[30] Foreign Application Priority Data

May 24, 1995 [DE] Germany ..... 195 19 992

[51] Int. Cl.[6] ..... H01H 33/88

[52] U.S. Cl. ..... 218/155; 218/43; 218/53; 218/62; 218/63

[58] Field of Search ..... 218/43, 46, 51, 218/53–64, 68, 72, 73, 76, 77, 81, 85, 155

[56] References Cited

U.S. PATENT DOCUMENTS

| | | | |
|---|---|---|---|
| 3,789,175 | 1/1974 | Beier et al. | 200/148 R |
| 4,229,627 | 10/1980 | Rostron | 200/144 R |
| 4,289,942 | 9/1981 | Milianowics | 200/148 A |

FOREIGN PATENT DOCUMENTS

| | | | |
|---|---|---|---|
| 191465 | 8/1986 | European Pat. Off. | H01H 33/91 |
| 1549097 | 10/1968 | France . | |
| 26 26855 | 10/1977 | Germany | H01B 3/00 |
| 30 46 629 C2 | 7/1982 | Germany | H01H 17/50 |
| 30 47 761 | 8/1982 | Germany | H01B 19/00 |
| 30 47 761 A1 | 8/1982 | Germany | H01H 17/14 |
| 95/08836 | 3/1995 | WIPO | H01H 33/70 |

*Primary Examiner*—Michael A. Friedhofer
*Attorney, Agent, or Firm*—Kenyon & Kenyon

[57] ABSTRACT

An insulating component for use in high-voltage switching equipment, especially gas-insulated switching gear. A nozzle made of an insulating material is used in a power switch. Portions of the surface of the nozzle subject to high dielectric stresses in use are provided with increased surface roughness in the form of grooves. These grooves may be cut by a lathe.

11 Claims, 3 Drawing Sheets

INSULATING COMPONENT FOR HIGH-VOLTAGE EQUIPMENT

FIELD OF THE INVENTION

The present invention relates to an insulating component for use in high-voltage switching equipment, and more particularly for use in a gas-insulated switch gear.

BACKGROUND INFORMATION

An insulating component is described, for example, in Germany Patent No. 26 26 855. These insulating components are used, for example, as spacers or nozzles for the feeding of insulating gas in electric high-voltage switches, particularly high-voltage power switches.

Such components are used as supports for busbar conductors or leadthroughs in, for example, encapsulated high-voltage switchgear. They may, for example, consist of cast resin, an epoxy resin, polytetrafluoroethylene ("PTFE"), a ceramic, or porcelain.

Under high dielectric stresses, such as in the case of high electrical field strengths, particularly if the field strength has a component tangential to the surface of the insulating component, there is an increased probability of displacement currents on the surface of the insulating component, which may also lead to electric arcing.

In accordance with the related art, a poorly conductive fabric is embedded in the region of the surface of the component in order to discharge surface charges.

While this certainly increases the conductivity of the component, it also contributes a substantial expense to the cost of the manufacture of the component. Different structural materials are combined with each other and there is the danger that a part of the fabric is not firmly bound to the component and extends into a dielectrically highly stressed region of the high-voltage equipment.

It is known from German Patent No. 30 47 761 to embed in an insulating component a mineral filler the particles of which lie freely on the surface of the component and prevent the formation of carbon-containing, and partially electrically conductive, tracks on the surface upon discharges. Such an insulating component is difficult to manufacture.

SUMMARY OF THE INVENTION

The object of the present invention is to provide an insulating component of the aforementioned type which permanently withstands high dielectric stresses and is economical to manufacture.

The object of the present invention is achieved by providing the surface of the component with sharp-edged grooves or ridges with a depth of roughness of at least 100 $\mu$m in at least one region which is particularly strongly stressed dielectrically.

One advantageous embodiment of the invention provides that at least one particularly dielectrically stressed region of the surface has a depth of roughness of at least 200 $\mu$m.

As a result of the depth of roughness, no displacement currents which could give rise to electric arcing can occur on the surface of the component.

In a cross section of the component, the latter has, in the region of its surface, sharp-edged elevations or recesses due to its surface structure. This structure leads to an improved dielectric strength since high electric field strengths occur on the tips and edges, which lead to the emission of surface charges and thus limit the potential of surface charges.

No additional material other than that of which the component is made of is necessary in order to achieve this result.

Another exemplary advantageous embodiment of the invention provides that the grooves or ridges are produced by machining.

In that case, the component, after it has been formed by casting, sintering or extrusion, can be worked further by lathe-cutting or milling in the dielectrically particularly stressed region.

A groove-depth more than 200 $\mu$m has been found to be particularly advantageous.

In the case of a component with rotational symmetry, the grooves may advantageously be concentric to each other or arranged in the form of a spiral.

This is particularly advantageous when the component is part of an insulating material nozzle for a high-voltage power switch. Since such a power switch is frequently designed with rotational symmetry, the regions which are particularly highly stressed dielectrically also exhibit rotational symmetry and can be provided with said grooves by suitable machining (turning).

The grooves or ridges may advantageously have a rectangular or saw-tooth cross section. Such a profile is simple to produce by turning on a lathe or milling.

The present invention furthermore refers to a method of producing an insulating component for high-voltage equipment in which the component, after it has been formed, is provided, in at least one dielectrically particularly highly stressed region of its surface, with grooves by machining or is worked in such a manner that ridges remain.

However, it is also possible for the component to be produced by a casting process and for the casting to have, in its dielectrically particularly strongly stressed region, grooves or ridges which produce corresponding complementary structures on the surface of the component.

After it has been formed, an insulating component frequently has a surface of uniform quality and can then be worked by the method of the present invention in the dielectrically particularly strongly stressed regions of its surface.

For example, it is also possible for a region of the surface to be provided with roughness using an embossing tool.

DETAILED DESCRIPTION OF THE INVENTION

Figure 1:
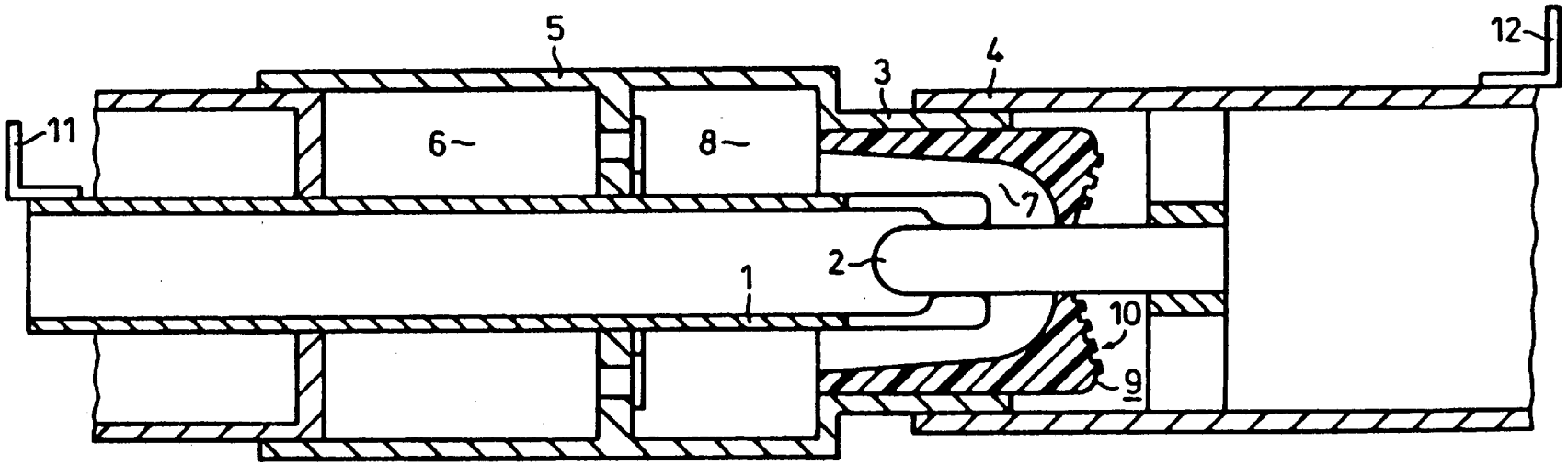
FIG. 1 shows a diagrammatic longitudinal section through an insulating material nozzle for a power switch, in which the insulating material is PTFE.

FIG. 1 shows a power switch in its "on" position. Two arc contact pieces 1 and 2, as well as two continuous-current contact pieces 3 and 4 lie opposite each other and are in contact with each other when the switch is turned on. Electric connections of the switch are designated 11, 12 and are shown merely diagrammatically.

In order to turn the switch off, the displaceable arc-contact piece 1 as well as the continuous-current contact piece 3 which is connected to it using a compression cylinder 5 are moved to the left in FIG. 1. This is done by a switch drive, not shown in detail.

At the same time, arc-extinguishing gas is compressed within a compression chamber 6.

After the separation of the two arc contact pieces 1 and 2 from each other, an arc is produced between them, with the arc heating the extinguishing gas within the region of the arc chamber 7. From arc chamber 7, the hot arc-extinguishing gas flows into heating chamber 8, where it is temporarily stored for the subsequent blowing-out of the arc.

After the displaceable arc contact piece 1 has separated from the stationary arc contact piece 2, the insulating material nozzle 9, which is made of PTFE, also separates from the stationary arc contact piece 2. The insulating material nozzle 9 is connected to the compression cylinder 5 in the region of the continuous-current contact 3.

Figure 2:
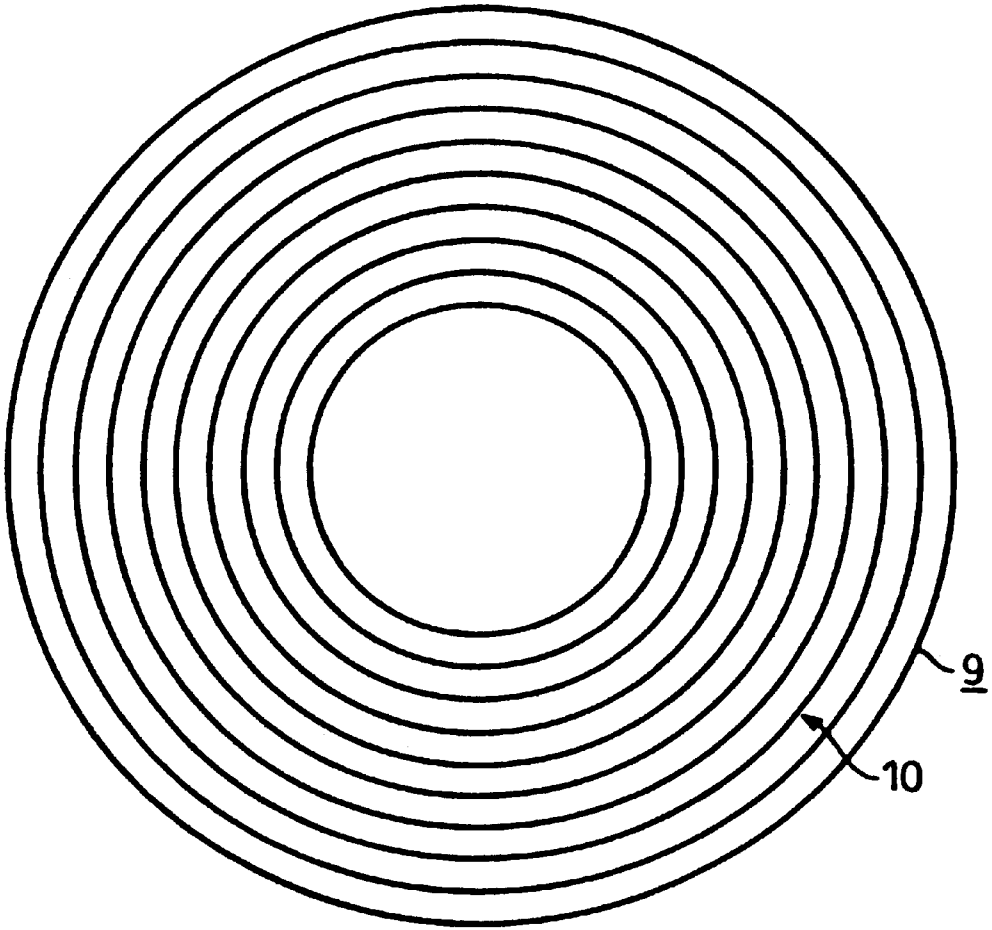
FIG. 2 shows a top view of the insulating material nozzle according to the present invention.

After the insulating material nozzle 9 has separated from the stationary arc contact piece 2, end face 10 of the insulating material nozzle is dielectrically stressed by the electric field between arc contact pieces 1 and 2. In this region, substantially concentric grooves (FIG. 2) of a width and depth of about 1 mm are produced by machining (for instance by cutting a spiral groove in the end surface), whereby a ridge of rectangular cross section having a width of about 1 mm is produced between the grooves.

An arrangement in accordance with the present invention is dielectrically safer than a component provided with an overall better surface quality produced by manufacture.

Figure 3:
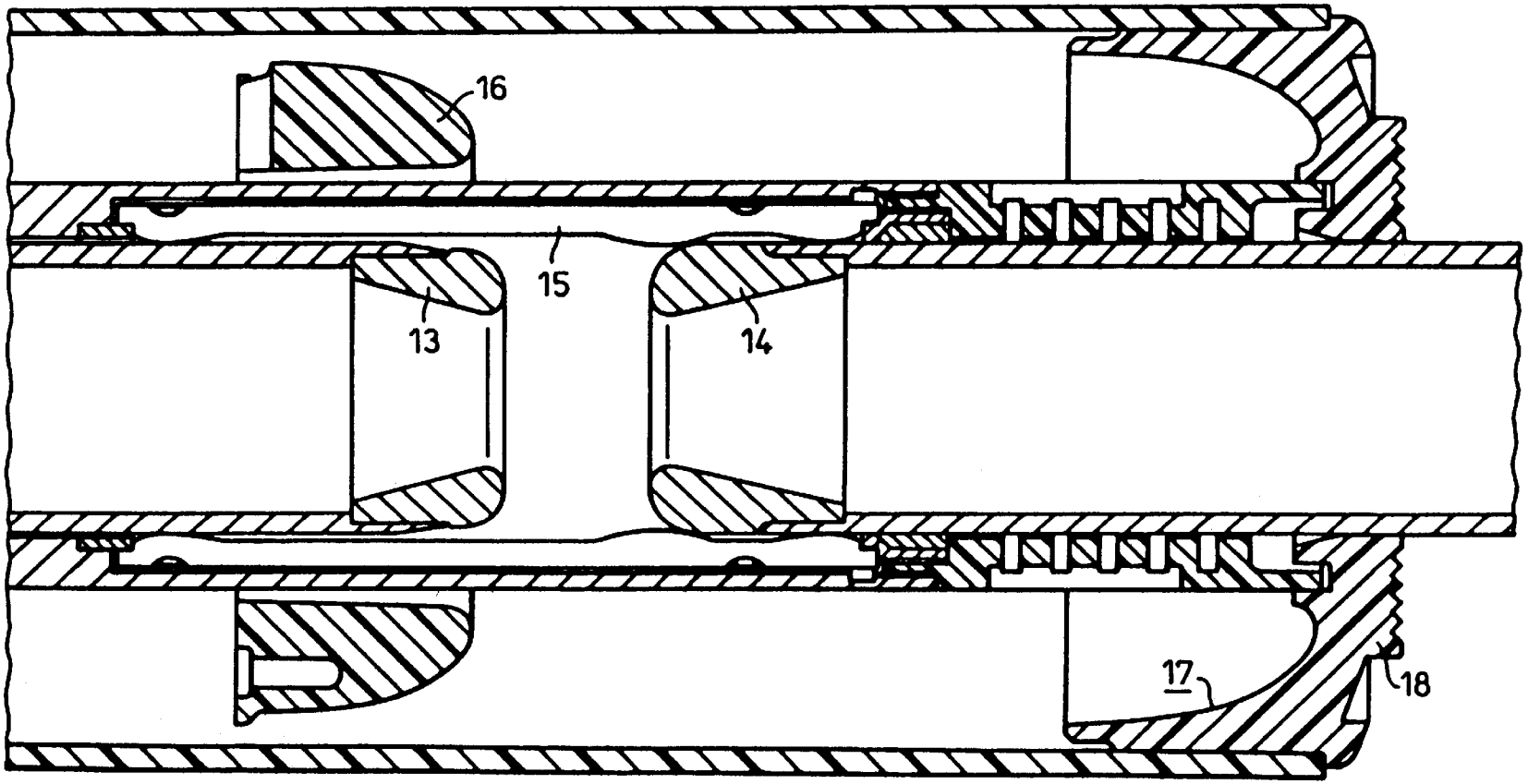
FIG. 3 shows diagrammatically, in longitudinal section, a double-nozzle power switch having a compression cylinder comprising of an insulating material.

FIG. 3 shows a double-nozzle switch with two fixed nozzle-shaped contact pieces 13 and 14 which are conductively connected to each other by a bridging switch piece 15 when the switch is turned on. A compression device for an arc-extinguishing gas, consisting of a stationary compression piston 16 and a movable compression cylinder 17, is provided. When the switch is turned off, the compression cylinder is pulled back to such an extent that its bottom 18 is located in the separation gap between the stationary contact pieces 13, 14 and is exposed there to the electrical field. Bottom 18 has, on its side facing the switch path when it is turned-off, a structure of saw-tooth shape in cross section, which permits a discharge of surface charges.

We claim:

1. An insulating component for a high-voltage switching equipment, comprising:

at least one region having a high dielectrical stress level and a roughness depth of at least 100 $\mu$m, the at least one region accommodating at least one of sharp-edged grooves and sharp-edged ridges on a surface of the insulating component; and an arrangement limiting a potential of surface charges along the at least one region.

2. An insulating component as set forth in claim 1, wherein the insulating component is used in a gas-insulated gear.

3. An insulating component as set forth in claim 1, wherein the at least one region has the roughness depth of at least 200 $\mu$m.

4. An insulating component as set forth in claim 1, wherein the at least one of the sharp-edged grooves and the sharp-edged ridges are produced by a machining procedure.

5. An insulating component as set forth in claim 4, wherein the insulating component has a rotational symmetry, and wherein the sharp-edged grooves are arranged in a spiral manner.

6. An insulating component as set forth in claim 1, wherein the insulating component has a rotational symmetry, and wherein the sharp-edged grooves are arranged in a substantially concentrically manner with respect to each other.

7. An insulating component as set forth in claim 1, wherein a cross-section of the least one of the sharped-edged grooves and the sharp-edged ridges has a rectangular shape.

8. An insulating component as set forth in claim 1, wherein a cross section of the least one of the sharp-edged grooves and the sharp-edged ridges has a saw-tooth shape.

9. An insulating component as set forth in claim 1, wherein the insulating component is composed of polytetrafluoroethylene.

10. An insulating component as set forth in claim 1, wherein the insulating component is a part of a nozzle body and is formed by a compression cylinder of the high-voltage switching equipment, the at least one of the sharp-edged grooves and the sharp-edged ridges being positioned on the at least one region.

11. A method for producing an insulating component of a high-voltage equipment, comprising the steps of:

forming the insulating component including an arrangement limiting a potential of surface charges along at least one region, the at least one region being capable of experiencing high dielectric stresses; and machining a plurality of at least one of grooves and ridges into the insulating component in the at least one region.

* * * * *